US010725404B2

(12) United States Patent
Shimodaira

(10) Patent No.: US 10,725,404 B2
(45) Date of Patent: Jul. 28, 2020

(54) GUIDE STRUCTURE, FIXING DEVICE, AND IMAGE FORMING APPARATUS

(71) Applicant: FUJI XEROX CO., LTD., Tokyo (JP)

(72) Inventor: Akira Shimodaira, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/260,144

(22) Filed: Jan. 29, 2019

(65) Prior Publication Data

US 2020/0033765 A1 Jan. 30, 2020

(30) Foreign Application Priority Data

Jul. 24, 2018 (JP) ..... 2018-138746

(51) Int. Cl.
*G03G 15/20* (2006.01)

(52) U.S. Cl.
CPC ..... *G03G 15/2028* (2013.01); *G03G 15/2064* (2013.01)

(58) Field of Classification Search
CPC ..... G03G 15/2028; G03G 15/2064; G03G 15/6573; G03G 15/6576
See application file for complete search history.

(56) References Cited

U.S. PATENT DOCUMENTS 7,149,463 B2 * 12/2006 Fujisawa ..... G03G 15/2028 399/323
2006/0133864 A1 * 6/2006 Tatematsu ..... G03G 15/2028 399/320

FOREIGN PATENT DOCUMENTS

JP 2003263060 9/2003

* cited by examiner

*Primary Examiner* — Gregory H Curran
(74) *Attorney, Agent, or Firm* — JCIPRNET

(57) ABSTRACT

A guide structure includes a contact member disposed downstream of a nipping unit in a transporting direction in which a recording medium is transported, the nipping unit nipping the recording medium between a heating roller, which heats an image formed on the recording medium that is transported, and a pressure roller, which presses the recording medium against the heating roller, the contact member protruding toward the recording medium and being rubbed against an image surface of the recording medium, on which the image is formed, while being in contact with the image surface over a region extending in a width direction of the recording medium and while the recording medium is nipped by the nipping portion.

11 Claims, 11 Drawing Sheets

GUIDE STRUCTURE, FIXING DEVICE, AND IMAGE FORMING APPARATUS

CROSS-REFERENCE TO RELATED APPLICATIONS

This application is based on and claims priority under 35 USC 119 from Japanese Patent Application No. 2018-138746 filed Jul. 24, 2018.

BACKGROUND

(i) Technical Field

The present disclosure relates to a guide structure, a fixing device, and an image forming apparatus.

(ii) Related Art

Japanese Unexamined Patent Application Publication No. 2003-263060 describes a fixing device including a fixing roller that includes a heat source, a pressure roller that is pressed against the fixing roller, and a separating member that is disposed close to the fixing roller and downstream of a fixing nip portion in a transporting direction of a recording medium.

SUMMARY

An image fixed to a recording medium by a fixing device includes portions having different thicknesses. Accordingly, the image has non-uniform brightness.

A guide member is disposed downstream of a nipping unit, which nips a recording medium that is transported between a heating roller and a pressure roller of a fixing device, in a transporting direction of the recording medium. The guide member guides the recording medium downstream in the transporting direction. According to the related art, the guide member is plate-shaped or curved. The recording medium comes into contact with a single flat surface or a single curved surface of the guide member and is thereby guided downstream in the transporting direction of the recording medium.

Aspects of non-limiting embodiments of the present disclosure relate to a technology for making the brightness of an image formed on a recording medium more uniform than that in the case where a recording medium nipped between a heating roller and a pressure roller is guided downstream in a transporting direction of the recording medium by a single flat surface or a single curved surface.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a guide structure including a contact member disposed downstream of a nipping unit in a transporting direction in which a recording medium is transported, the nipping unit nipping the recording medium between a heating roller, which heats an image formed on the recording medium that is transported, and a pressure roller, which presses the recording medium against the heating roller, the contact member protruding toward the recording medium and being rubbed against an image surface of the recording medium, on which the image is formed, while being in contact with the image surface over a region extending in a width direction of the recording medium and while the recording medium is nipped by the nipping portion.

BRIEF DESCRIPTION OF THE DRAWINGS

Exemplary embodiments of the present disclosure will be described in detail based on the following figures, wherein.

DETAILED DESCRIPTION

First Exemplary Embodiment

Figure 1:
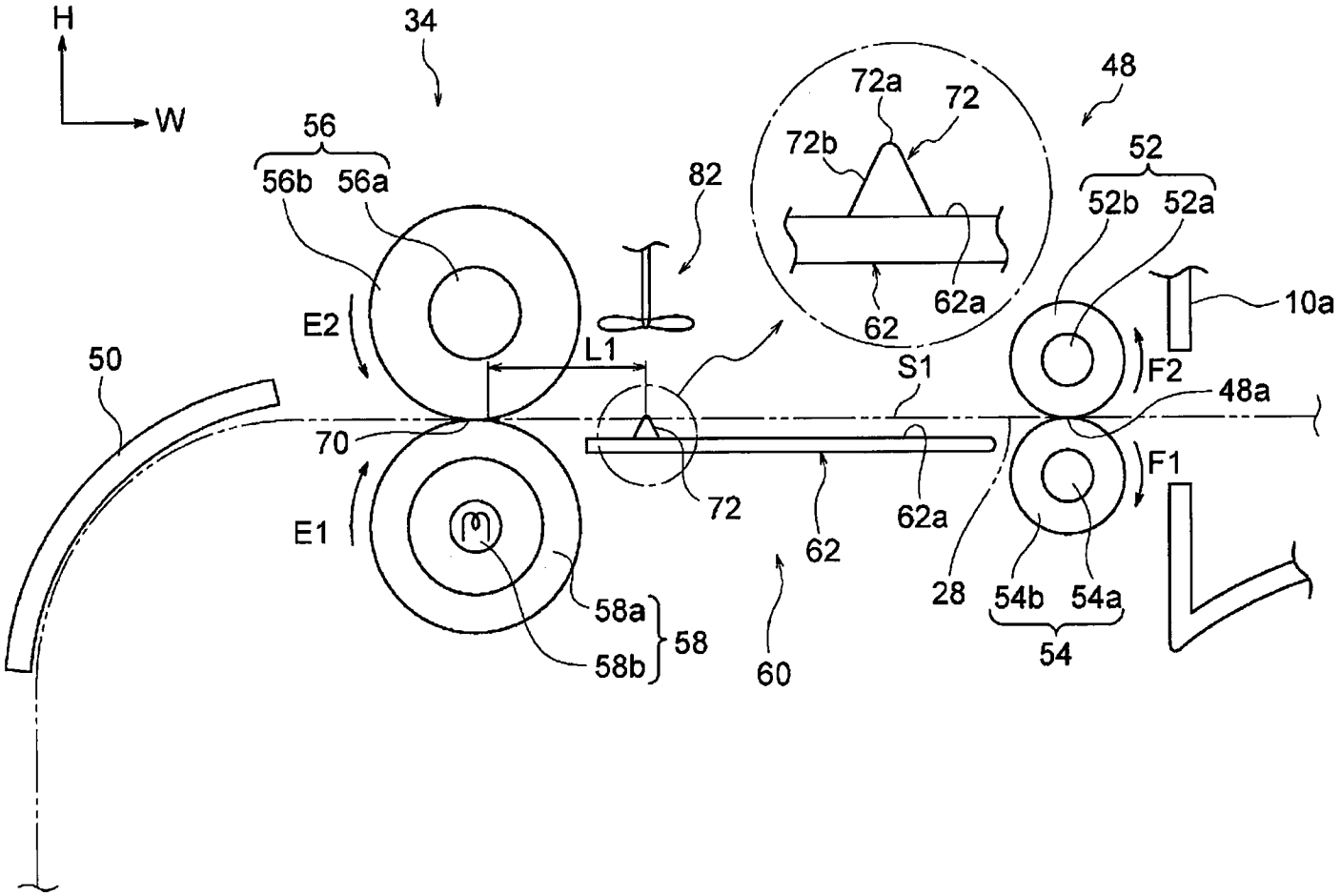
FIG. 1 is a side view of a guide structure and other structures according to a first exemplary embodiment of the present disclosure.

An example of a guide structure, a fixing device, and an image forming apparatus according to a first exemplary embodiment of the present disclosure will be described with reference to FIGS. 1 to 7. In the drawings, arrow H indicates an apparatus up-down direction (vertical direction), arrow W an apparatus width direction (horizontal direction), and arrow D an apparatus depth direction (horizontal direction).

Image Forming Apparatus 10

Figure 7:
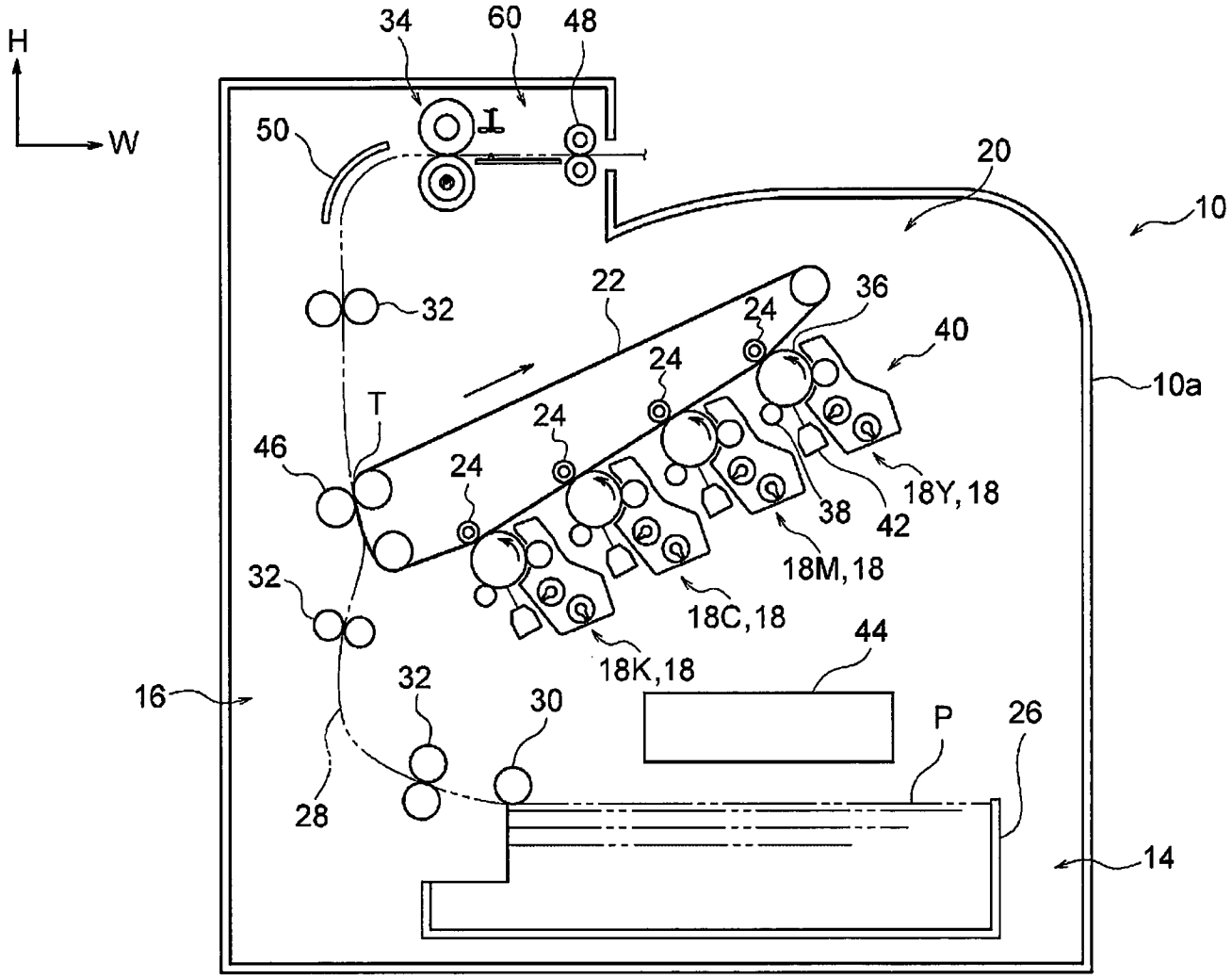
FIG. 7 is a schematic diagram illustrating the image forming apparatus according to the first exemplary embodiment of the present disclosure.

As illustrated in FIG. 7, an image forming apparatus 10 includes a storage unit 14, a transport unit 16, and an image forming section 20, which are arranged in that order from the bottom toward the top in the up-down direction. The storage unit 14 stores sheet members P, which serve as recording media. The transport unit 16 transports the sheet members P stored in the storage unit 14. The image forming section 20 forms images on the sheet members P transported from the storage unit 14 by the transport unit 16. The image forming apparatus 10 also includes a controller 44 that controls each unit.

Storage Unit

The storage unit 14 includes a storage member 26 that may be pulled forward from an apparatus body 10*a* of the image forming apparatus 10 in the apparatus depth direction. The sheet members P are stacked on the storage member 26. The storage unit 14 also includes a feed roller 30 that feeds the top sheet member P of the stack on the storage member 26 to a transport path 28, which is included in the transport unit 16.

Transport Unit

The transport unit 16 includes plural transport roller units 32 that transport the sheet member P along the transport path 28, and a discharge roller unit 48 that discharges the sheet member P to the outside of the apparatus body 10*a* along the transport path 28 after a toner image is formed on the sheet member P. The discharge roller unit 48 is an example of a transport roller unit.

The transport unit 16 also includes a guide structure 60 that smoothes a toner image that has been fixed to the sheet member P by a fixing device 34, which will be described below. The transport unit 16 also includes a curved guide plate 50 that changes the transporting direction of the sheet member P from an upward direction to the apparatus width direction. The discharge roller unit 48 and the guide structure 60 will be described in detail below.

Image Forming Section

The image forming section 20 includes four image forming units 18Y, 18M, 18C, and 18K, which are yellow (Y), magenta (M), cyan (C), and black (K) image forming units, respectively. In the following description, the characters Y, M, C, and K may be omitted when it is not necessary to distinguish between Y, M, C, and K.

Figure 6:
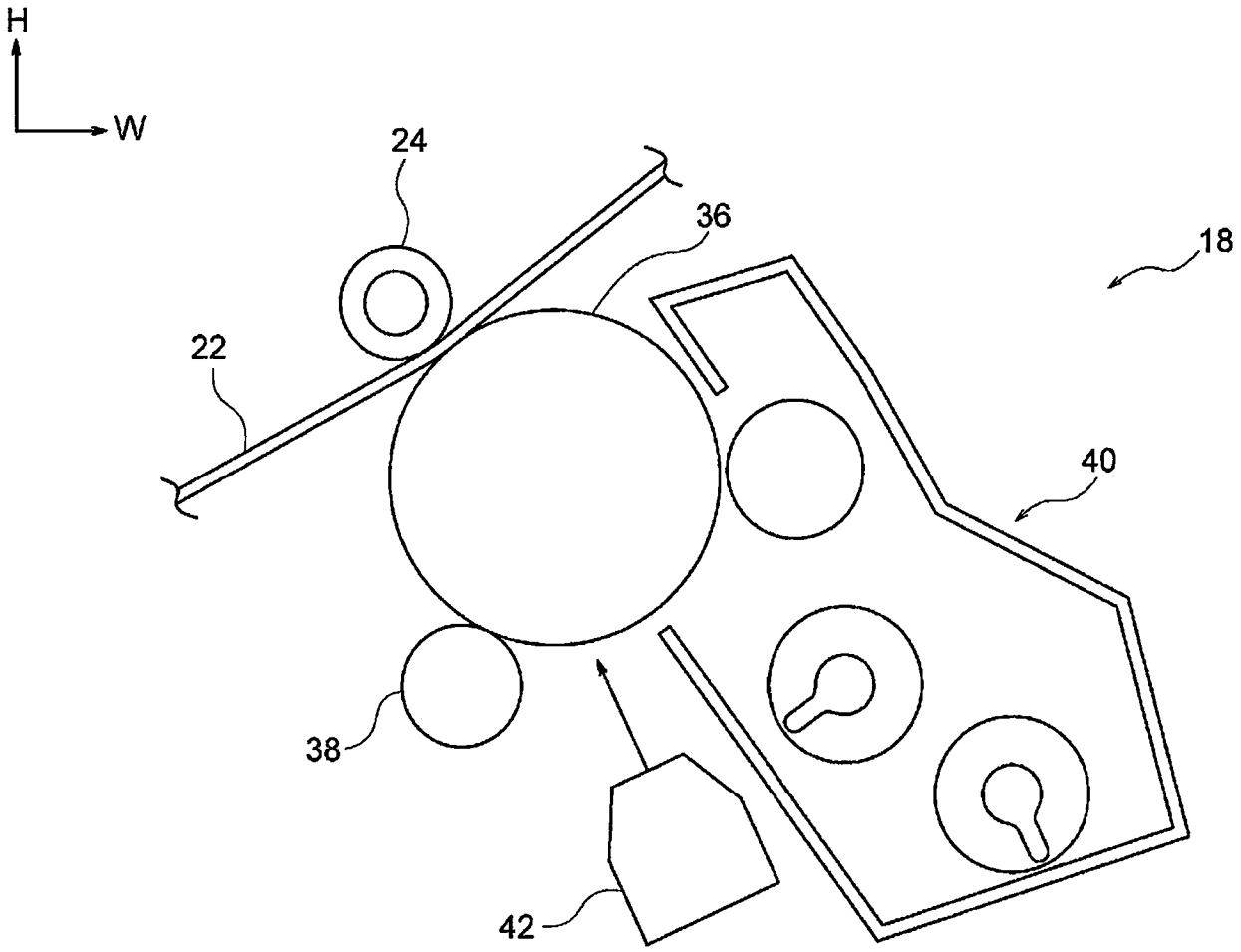
FIG. 6 illustrates an image forming unit included in an image forming apparatus according to the first exemplary embodiment of the present disclosure.

As illustrated in FIG. 6, each image forming unit 18 includes an image carrier 36 that carries an image and a charging roller 38 that charges the surface of the image carrier 36. Each image forming unit 18 also includes an exposure device 42 that irradiates the charged surface of the image carrier 36 with exposure light to form an electrostatic latent image and a developing device 40 that develops and visualizes the electrostatic latent image into a toner image.

As illustrated in FIG. 7, the image forming section 20 also includes an endless transfer belt 22 to which the toner images formed by the image forming units 18 of the respective colors are transferred and first transfer rollers 24 that transfer the toner images formed by the image forming units 18 onto the transfer belt 22. The image forming section 20 also includes a second transfer roller 46 that transfers the toner images that have been transferred to the transfer belt 22 onto the sheet member P. The image forming section 20 also includes the fixing device 34 that fixes the toner image on the sheet member P to the sheet member P by heating and pressing the toner image. The fixing device 34 will be described in detail below.

Operation of Image Forming Apparatus

The image forming apparatus 10 forms an image in the following manner.

First, the charging rollers 38 of the respective colors, to which a voltage is applied, come into contact with the surfaces of the image carriers 36 of the respective colors and uniformly charge the surfaces of the image carriers 36 to a predetermined negative potential. Subsequently, the exposure devices 42 of the respective colors form electrostatic latent images by irradiating the charged surfaces of the image carriers 36 of the respective colors with exposure light based on data input from the outside.

Thus, the electrostatic latent images corresponding to the image data are formed on the surfaces of the image carriers 36. The developing devices 40 of the respective colors develop and visualize the electrostatic latent images into toner images. The first transfer rollers 24 transfer the toner images formed on the surfaces of the image carriers 36 of the respective colors onto the transfer belt 22.

The feed roller 30 feeds the top sheet member P of the stack on the storage member 26 toward a transfer position T, at which the transfer belt 22 and the second transfer roller 46 are in contact with each other, along the transport path 28. The second transfer roller 46 and the transfer belt 22 transport the sheet member P while nipping the sheet member P therebetween at the transfer position T, so that the toner image on the transfer belt 22 is transferred to the sheet member P.

The fixing device 34 fixes the toner image that has been transferred to the sheet member P to the sheet member P. The sheet member P to which the toner image is fixed is discharged to the outside of the apparatus body 10*a* by the discharge roller unit 48.

Relevant Structure

The discharge roller unit 48, the fixing device 34, and the guide structure 60 according to the present exemplary embodiment will now be described.

Discharge Roller Unit 48

As illustrated in FIG. 1, the discharge roller unit 48 includes a first roller 52 and a second roller 54.

The first roller 52 includes a shaft 52*a* that extends in the apparatus depth direction and plural roller portions 52*b* that are cylindrical and through which the shaft 52*a* extends. The first roller 52 is rotatably supported by support members (not shown) at both ends of the shaft 52*a*.

The second roller 54 faces the first roller 52 with the transport path 28, along which the sheet member P is transported, disposed therebetween. More specifically, the second roller 54 is disposed below the first roller 52 and faces the first roller 52 with the transport path 28, along which the sheet member P is transported, disposed therebetween. Thus, a portion of the transport path 28 along which the sheet member P is transported by the first roller 52 and the second roller 54 extends in the apparatus width direction when viewed in the apparatus depth direction.

The second roller 54 includes a shaft 54*a* that extends in the apparatus depth direction and plural roller portions 54*b* that are cylindrical and through which the shaft 54*a* extends. A rotational force is transmitted to the second roller 54 from a driving member (not shown), so that the second roller 54 is rotated in the direction of arrow F1 and the first roller 52 is rotated by the second roller 54 in the direction of arrow F2.

Fixing Unit 34

As illustrated in FIG. 1, when viewed in the apparatus depth direction, the fixing device 34 is disposed on one side of the discharge roller unit 48 (same side as the second transfer roller 46 in FIG. 7) in the apparatus width direction. The fixing device 34 includes a heating roller 58 that heats the toner image formed on the sheet member P and a pressure roller 56 that presses the sheet member P against the heating roller 58.

Pressure Roller 56

The pressure roller 56 is disposed above the transport path 28 along which the sheet member P is transported. The pressure roller 56 includes a shaft 56*a* that extends in the apparatus depth direction, a cylindrical rubber portion 56*b*, and a coating (not shown) that covers the rubber portion 56*b*.

The shaft 56*a* extends through the rubber portion 56*b*, and both end portions of the shaft 56*a* project from the rubber portion 56*b*. The pressure roller 56 is rotatably supported by support members (not shown) at both ends of the shaft 56*a*, and the support members are urged by urging members so that the pressure roller 56 is urged against the heating roller 58. Accordingly, the pressure roller 56 presses the sheet member P that is transported against the heating roller 58. More specifically, the pressure roller 56 comes into contact with a non-image surface of the sheet member P that is transported and presses the sheet member P against the heating roller 58.

Heating Roller 58

The heating roller 58 faces the pressure roller 56 with the transport path 28, along which the sheet member P is transported, disposed therebetween. More specifically, the heating roller 58 is disposed below the pressure roller 56 and faces the pressure roller 56 with the transport path 28, along which the sheet member P is transported, disposed therebetween. Thus, a portion of the transport path 28 along which the sheet member P is transported by the heating roller 58 and the pressure roller 56 extends in the apparatus width direction when viewed in the apparatus depth direction.

The heating roller 58 includes a cylindrical shaft 58*a* that extends in the apparatus depth direction, a coating (not shown) that covers the shaft 58*a*, and a heating portion 58*b* disposed in the shaft 58*a*.

The pressure roller 56 is arranged to press the sheet member P against the heating roller 58, so that a nip portion 70 that nips the sheet member P that is transported is formed between the pressure roller 56 and the heating roller 58. The nip portion 70 is an example of a nipping unit.

In this configuration, the surface temperature of the heating roller 58 is, for example, 190° C. A rotational force is transmitted to the heating roller 58 from a driving member (not shown), so that the heating roller 58 is rotated in the direction of arrow E1 and the pressure roller 56 is rotated by the heating roller 58 in the direction of arrow E2. Thus, the fixing device 34 transports the sheet member P toward the discharge roller unit 48 while the sheet member P is nipped between the pressure roller 56 and the heating roller 58. In addition, the heating roller 58 comes into contact with an image surface of the sheet member P that is transported and heats the toner image formed on the sheet member P. In the present exemplary embodiment, the transport speed at which the fixing device 34 transports the sheet member P is, for example, 60 mm/s.

Guide Structure 60

As illustrated in FIG. 1, the guide structure 60 is disposed between the fixing device 34 and the discharge roller unit 48 in the transporting direction of the sheet member P. The guide structure 60 includes a guide member 62 disposed below the transport path 28, a protruding contact member 72 attached to the guide member 62, and fans 82 disposed above the transport path 28. In other words, the guide member 62 and the contact member 72 face the image surface of the sheet member P that is transported (surface on which the toner image is formed). The fans 82 are an example of a pressing member.

Guide Member 62

The guide member 62 is disposed below the sheet member P that is transported by the heating roller 58 and the pressure roller 56 (see FIG. 4A). The guide member 62 is made of acrylonitrile-butadiene-styrene resin (hereinafter referred to as "ABS resin"), which is an example of a resin material.

As illustrated in FIG. 1, the guide member 62 is flat-plate-shaped, and plate surfaces thereof face in the up-down direction. The guide member 62 has a transporting surface 62*a* that faces upward toward the transport path 28. When viewed from above, the guide member 62 has a rectangular shape that extends in the apparatus depth direction, and covers the entirety of the transported sheet member P in the apparatus depth direction (see FIG. 5).

Contact Member 72

The contact member 72 comes into contact with the image surface of the sheet member P over a region extending in the width direction of the sheet member P while the sheet member P is nipped by the nip portion 70 of the fixing device 34. The contact member 72 is made of acrylonitrile-butadiene-styrene resin (hereinafter referred to as "ABS resin"), which is an example of a resin material, and is formed integrally with the transporting surface 62*a* of the guide member 62.

As illustrated in FIG. 1, when viewed in the apparatus depth direction (width direction of the sheet member P), the contact member 72 has a triangular shape with a vertex pointing upward (toward the sheet member P that is transported). The vertex has a curved surface 72*a* that is rounded. Thus, the contact member 72 protrudes toward the sheet member P that is transported. Here, to protrude toward the sheet member P that is transported means to have two surfaces facing upstream and downstream in the transporting direction of the sheet member P and forming a ridge that faces the sheet member P.

Figure 3B:
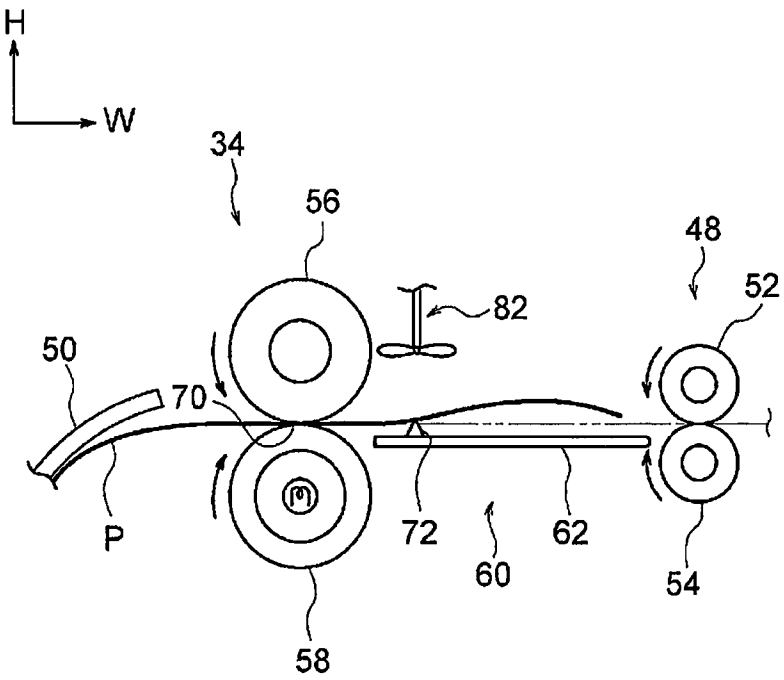
FIGS. 3A and 3B illustrate the manner in which the guide structure and other structures according to the first exemplary embodiment of the present disclosure transport the sheet member.
Figure 3A:
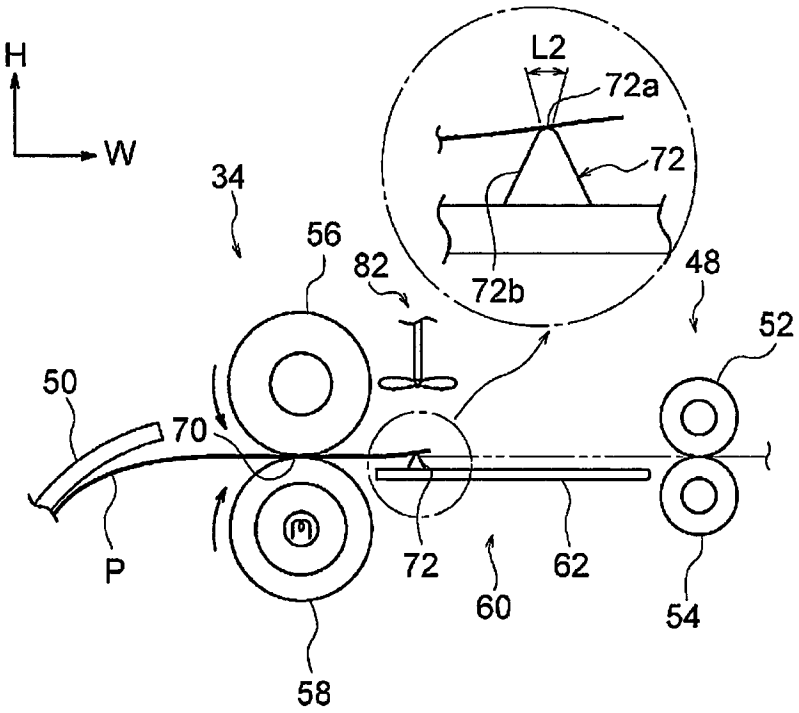

The curved surface 72*a* of the contact member 72 is arranged to be pressed against the image surface of the sheet member P that is nipped by the nip portion 70 of the fixing device 34 (see FIG. 3A). In other words, when viewed in the apparatus depth direction, the curved surface 72*a* of the contact member 72 and the guide member 62 are on the opposite sides of a straight line (S1 in FIG. 1) that passes through a contact portion 48*a* between the first roller 52 and the second roller 54 of the discharge roller unit 48 and the nip portion 70 of the fixing device 34.

The contact member 72 has a flat guide surface 72*b* that comes into contact with the leading end of the sheet member P and guides the leading end of the sheet member P toward the curved surface 72*a*. The contact member 72 extends in the width direction of the sheet member P, and the curved surface 72*a* of the contact member 72 comes into contact with the image surface of the transported sheet member P over a region from one end to the other end.

The curved surface 72*a* of the contact member 72 comes into contact with the transported sheet member P and is pressed against the image surface of the sheet member P, thereby changing the position of the sheet member P that is transported. Thus, the contact member 72 functions as a changing member that changes the position of the sheet member P by coming into contact with the image surface of the sheet member P that is transported.

According to the present exemplary embodiment, for example, the contact member 72 has an equilateral triangular shape when viewed in the apparatus depth direction, and the curved surface 72*a* has a radius of 2.4 mm.

Figure 2B:
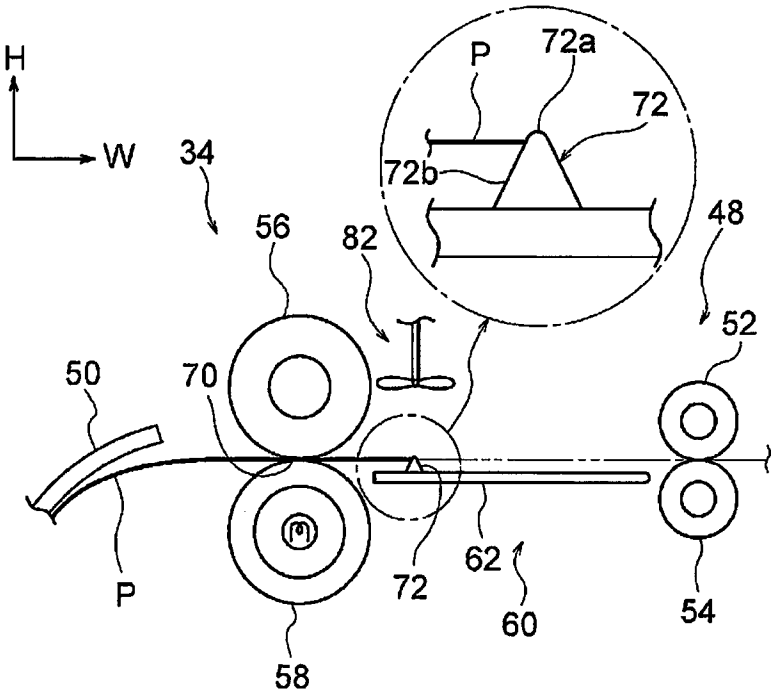
FIGS. 2A and 2B illustrate the manner in which the guide structure and other structures according to the first exemplary embodiment of the present disclosure transport a sheet member.

In this configuration, as illustrated in FIGS. 2B and 3A, the guide surface 72*b* of the contact member 72 comes into contact with the leading end of the sheet member P that is transported by the fixing device 34, and guides the leading end of the sheet member P toward the curved surface 72*a*.

In addition, the curved surface 72*a* of the contact member 72 comes into contact with the image surface of the sheet member P and smoothes the surface of the toner image.

To smooth the surface of the toner image, the curved surface 72*a* of the contact member 72 may be arranged to come into contact with the image surface of the sheet member P before the toner image solidifies. For this purpose, the distance from the nip portion 70 of the fixing device 34 to the curved surface 72*a* (L1 in FIG. 1) may be as short as possible. More specifically, the distance L1 may be in the range from 15 mm to 40 mm, preferably in the range from 15 mm to 35 mm, and more preferably in the range from 15 mm to 30 mm.

In addition, to smooth the surface of the toner image, the contact length over which the curved surface 72*a* comes into contact with the sheet member P in the transporting direction of the sheet member P (L2 in FIG. 3A) may be as short as possible. More specifically, the distance L2 may be less than or equal to 5 mm, preferably less than or equal to 4 mm, and more preferably less than or equal to 3 mm. The contact length is the length over which the curved surface 72*a* comes into contact with the sheet member P while the sheet member P is nipped by the nip portion 70 and held in a cantilever manner.

Fans 82

As illustrated in FIG. 1, the fans 82 face the contact member 72 with the transport path 28 disposed therebetween, and are arranged in the apparatus depth direction.

In this configuration, the fans 82 blow air toward the non-image surface of the sheet member P, thereby pressing the image surface of the sheet member P against the contact member 72.

Operation of Relevant Structure

The operation of the relevant structure according to the first exemplary embodiment will now be described.

Figure 2A:
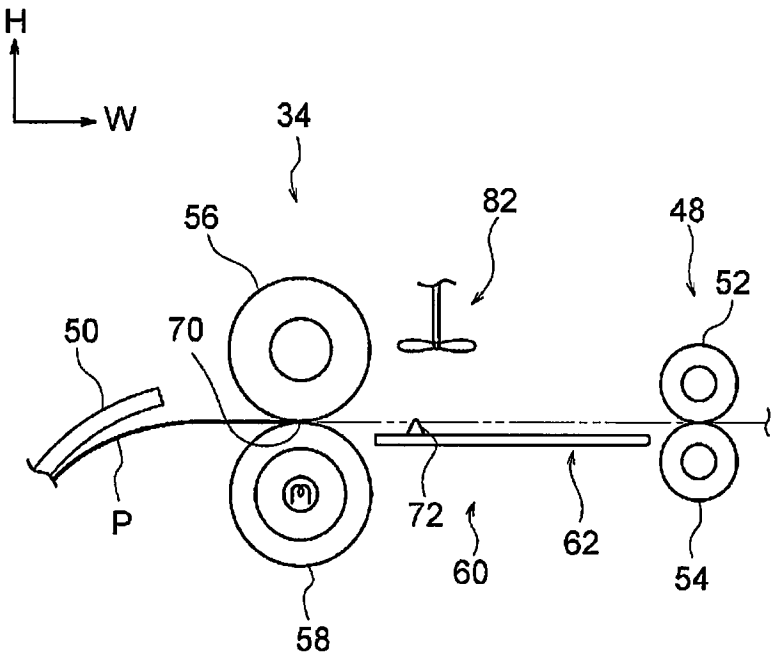

After the toner image is transferred to the sheet member P, the sheet member P is transported to the fixing device 34. Then, as illustrated in FIG. 2A, the heating roller 58 and the pressure roller 56 of the fixing device 34 transport the sheet member P by rotating while the sheet member P is nipped therebetween.

The pressure roller 56 presses the sheet member P against the heating roller 58, and the heating roller 58 heats the toner image formed on the sheet member P. Thus, the heating roller 58 heats the toner image formed on the sheet member P to, for example, about 100° C., so that the toner image is fixed to the sheet member P. The image fixed to the sheet member P by the fixing device 34 includes portions having different thicknesses.

As illustrated in FIG. 2B, the leading end of the sheet member P that is nipped and transported by the nip portion 70 between the pressure roller 56 and the heating roller 58 comes into contact with the guide surface 72*b* of the contact member 72. The guide surface 72*b* of the contact member 72 comes into contact with the leading end of the sheet member P nipped by the nip portion 70 and guides the leading end of the sheet member P toward the curved surface 72*a*, as illustrated in FIG. 3A. The curved surface 72*a* of the contact member 72 also comes into contact with the image surface of the sheet member P. More specifically, the curved surface 72*a* of the contact member 72 extends in the width direction of the sheet member P, and comes into contact with the image surface of the sheet member P over a region from one end to the other end. In other words, the curved surface 72*a* of the contact member 72 comes into contact with the entire region of the toner image from one end to the other end, and makes the thickness of the toner image including portions having different thicknesses uniform over the entire area thereof.

The fans 82 blow air toward the non-image surface of the sheet member P, thereby pressing the image surface of the sheet member P against the curved surface 72*a* of the contact member 72.

Figure 4B:
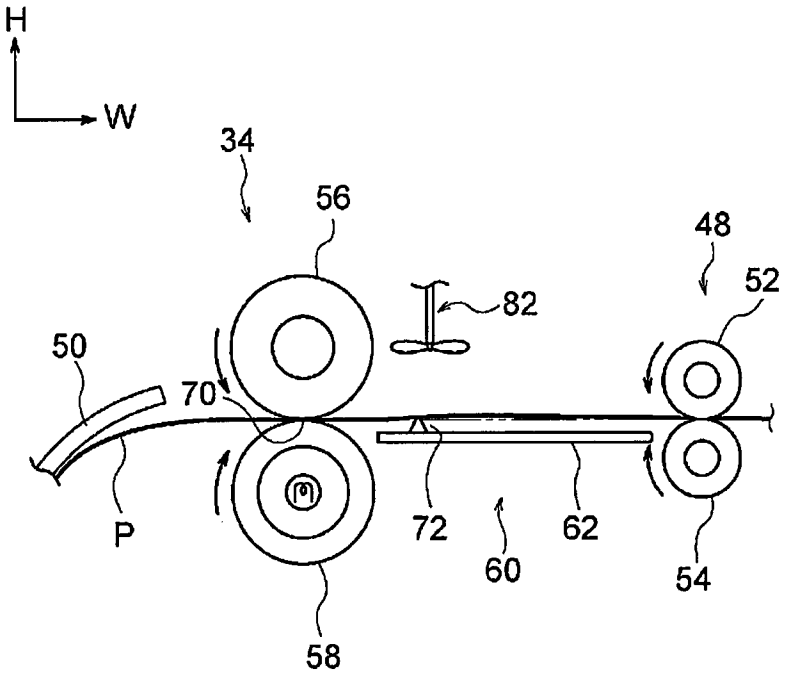
FIGS. 4A and 4B illustrate the manner in which the guide structure and other structures according to the first exemplary embodiment of the present disclosure transport the sheet member.
Figure 4A:
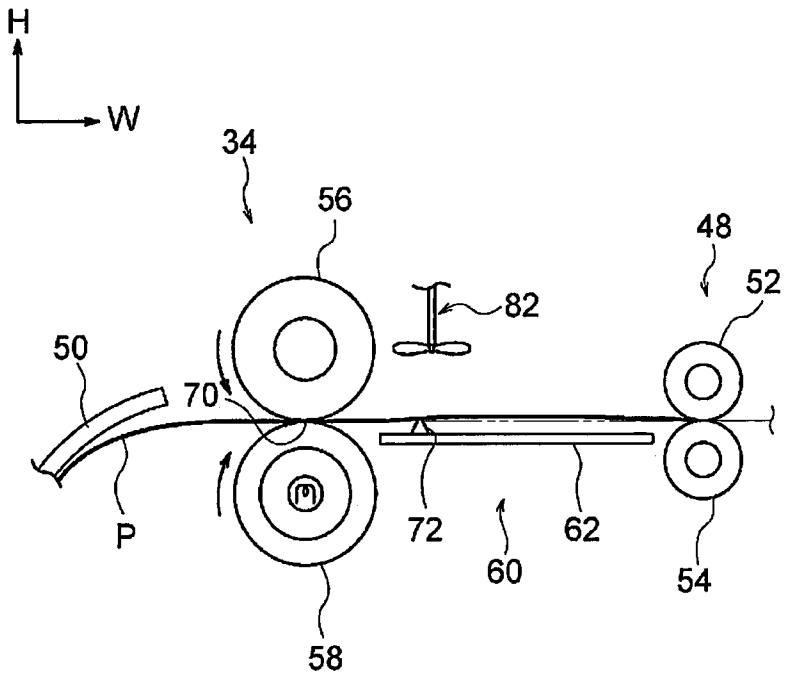
Figure 5:
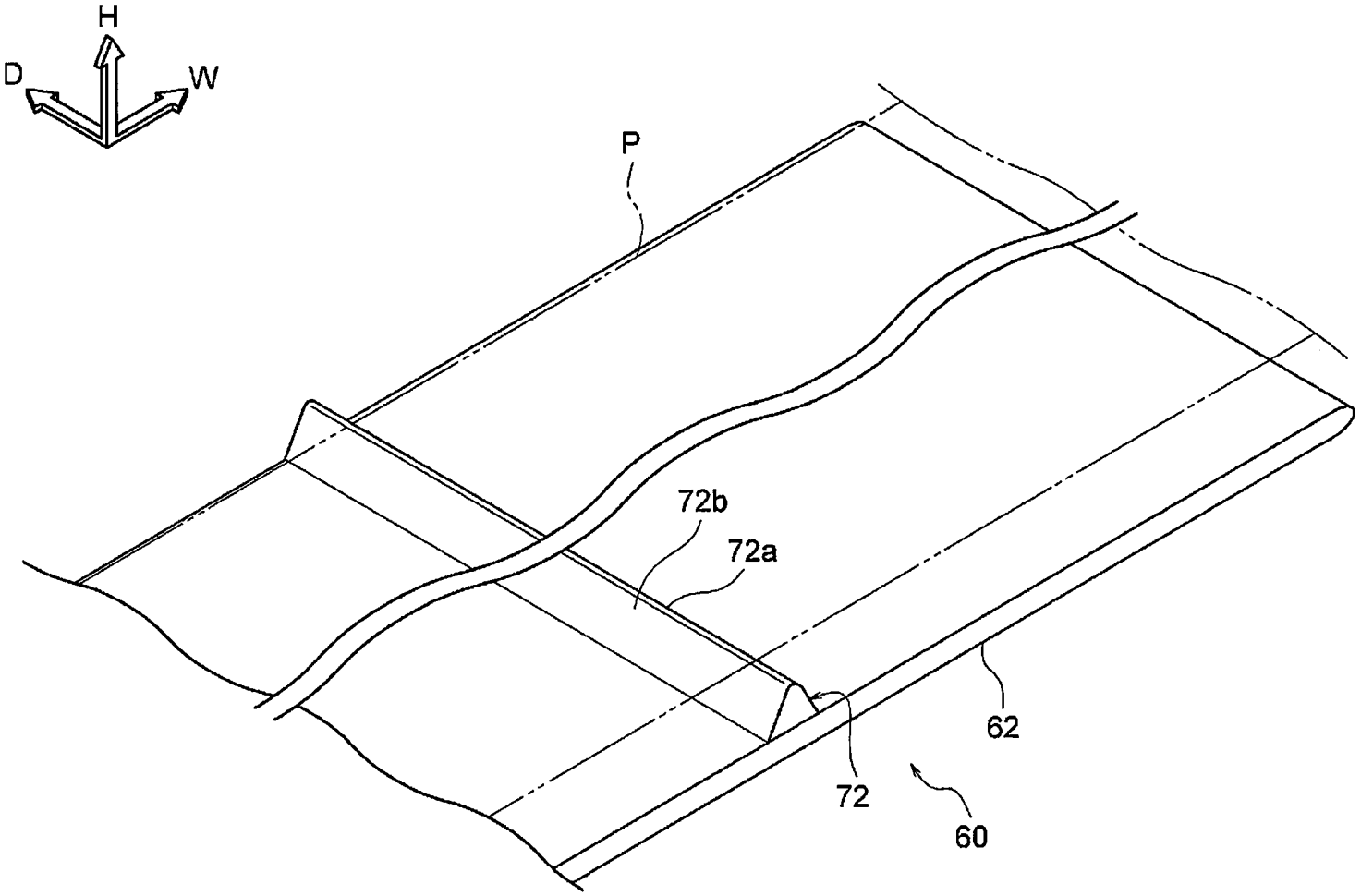
FIG. 5 is a perspective view of a guide member and a contact member included in the guide structure according to the first exemplary embodiment of the present disclosure.

Then, as illustrated in FIGS. 3B, 4A, and 4B, the sheet member P is nipped between the first roller 52 and the second roller 54 of the discharge roller unit 48 at the leading end thereof and is transported by the discharge roller unit 48 while the sheet member P is nipped by the nip portion 70 and while the image surface of the sheet member P is in contact with the curved surface 72*a*.

As a result, the surface of the toner image formed on the sheet member P is smoothed. Then, the discharge roller unit 48 transports the sheet member P to discharge the sheet member P to the outside of the apparatus body 10*a* (see FIG. 7).

SUMMARY

As described above, the guide structure 60 is configured such that the image surface of the sheet member P nipped by the nip portion 70 between the heating roller 58 and the pressure roller 56 comes into contact with the curved surface 72*a* of the contact member 72 over a region extending in the width direction of the sheet member P. Thus, the surface of the toner image formed on the sheet member P is smoothed.

More specifically, the surface of the toner image formed on the sheet member P becomes smoother than that in the case where the sheet member P nipped by the nip portion 70 is guided downstream in the transporting direction of the sheet member P by a single flat surface or a single curved surface. In other words, the brightness of the toner image formed on the sheet member P is more uniform than that in the case where the sheet member P nipped by the nip portion 70 is guided downstream in the transporting direction of the sheet member P by a single flat surface or a single curved surface.

In addition, the contact member 72 of the guide structure 60 extends in the width direction of the sheet member P. Thus, unlike the case where the contact member extends in a direction at an angle with respect to the width direction of the sheet member P, the above-described distance L1 (see FIG. 1) is uniform in the width direction of the sheet member P. Accordingly, the pressing force that presses the contact member 72 against the image surface of the sheet member P is uniform in the width direction of the sheet member P, so that the surface of the toner image formed on the sheet member P is smoothed. In other words, according to the guide structure 60, the brightness of the toner image formed on the sheet member P is more uniform than that in the case where the contact member extends in a direction at an angle with respect to the width direction of the sheet member P.

In addition, the fans 82 of the guide structure 60 press the sheet member P that is transported against the curved surface 72*a* of the contact member 72. Accordingly, the pressing force that presses the sheet member P against the curved surface 72*a* is greater than that in the case where the sheet member P is pressed against the curved surface 72*a* only by gravity. As a result, the surface of the toner image formed on the sheet member P is smoothed, so that the brightness of the toner image formed on the sheet member P is made more uniform.

In addition, the fans 82 of the guide structure 60 press the sheet member P that is transported against the curved surface 72*a* of the contact member 72. Accordingly, variation in the pressing force is less than that in the case where the sheet member P is nipped between a transport roller and the curved surface 72*a* to press the sheet member P against the curved surface 72*a*, in which case the pressing force varies in accordance with variations in the relative positions of the transport roller and the curved surface 72*a*. Thus, the brightness of the toner image formed on the sheet member P is made more uniform.

In addition, the contact member 72 of the guide structure 60 is arranged to be pressed against the image surface of the sheet member P in the thickness direction of the sheet member P while the sheet member P is nipped by the nip portion 70. In other words, the position of the sheet member P nipped by the nip portion 70 is changed when the sheet member P comes into contact with the contact member 72. Therefore, the surface of the toner image formed on the sheet member P becomes smoother than that in the case where the sheet member P is pressed against the contact member only by gravity. As a result, the brightness of the toner image formed on the sheet member P is made more uniform.

In addition, the contact member 72 of the guide structure 60 includes the curved surface 72*a* that comes into contact with the image surface of the sheet member P and the guide surface 72*b* that comes into contact with the leading end of the sheet member P that is transported and guides the sheet member P toward the curved surface 72*a*. Thus, the structure is simpler than that in the case where the guide surface that guides the sheet member P toward the curved surface 72*a* is formed on a member other than the contact member.

According to the image forming apparatus 10, the brightness of the toner image is more uniform than that in the case where the sheet member P nipped by the nip portion 70 is guided downstream in the transporting direction of the sheet member P by a single flat surface or a single curved surface. As a result, reduction in the quality of the output image is suppressed.

Second Exemplary Embodiment

An example of a guide structure and an image forming apparatus according to a second exemplary embodiment of the present disclosure will now be described with reference to FIGS. 8 to 11. Differences between the first and second exemplary embodiments will be basically described.

Structure

Figure 8:
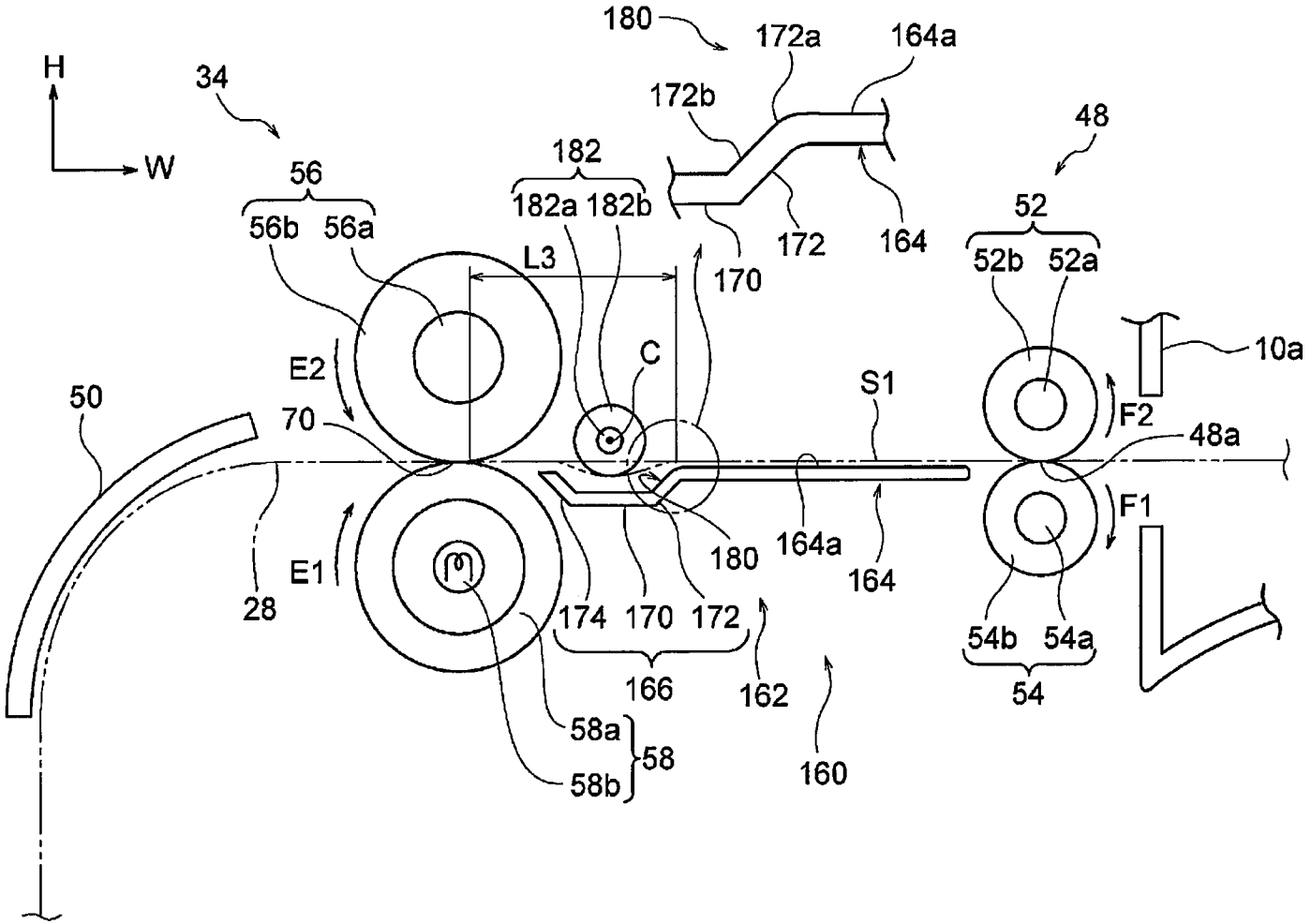
FIG. 8 is a side view of a guide structure and other structures according to a second exemplary embodiment of the present disclosure.

As illustrated in FIG. 8, a guide structure 160 according to the second exemplary embodiment is disposed between the fixing device 34 and the discharge roller unit 48 in the transporting direction of the sheet member P. The guide structure 160 includes a guide member 162 disposed below the transport path 28 and a pressing roller 182 disposed above the transport path 28. The pressing roller 182 is an example of a pressing member.

Guide Member 162

The guide member 162 is disposed below the sheet member transported by the heating roller 58 and the pressure roller 56 (see FIG. 10B). The guide member 162 is composed of a stainless steel plate.

The cross section of the guide member 162 along a plane that crosses the apparatus depth direction is substantially constant in the apparatus depth direction. The guide member 162 includes a flat plate portion 164 having plate surfaces facing in the up-down direction and a recessed portion 166 that is recessed downward in a direction away from the transport path 28. The recessed portion 166 and the flat plate portion 164 are arranged in that order from the upstream side toward the downstream side in the transporting direction of the sheet member P. When viewed from above, the guide member 162 has a rectangular shape that extends in the apparatus depth direction and covers the entirety of the transported sheet member P in the apparatus depth direction. The flat plate portion 164 has a transporting surface 164*a* that faces the transport path 28.

When viewed in the apparatus depth direction, the recessed portion 166 is recessed such that the opening thereof increases toward the top. More specifically, the recessed portion 166 includes a bottom plate 170, an inclined plate 172 that is closer to the flat plate portion 164 than the bottom plate 170 is and that is inclined with respect to the up-down direction, and an inclined plate 174 that faces the inclined plate 172 with the bottom plate 170 disposed therebetween and that is inclined with respect to the up-down direction.

The downstream end of the inclined plate 172 and the upstream end of the flat plate portion 164 in the transporting direction of the sheet member P are connected to each other, and the ridge between the inclined plate 172 and the flat plate portion 164 has a curved surface 172*a* that is rounded. The inclined plate 172 has a flat guide surface 172*b* that faces the transport path 28. The guide surface 172*b* comes into contact with the leading end of the sheet member P that is transported and guides the leading end of the sheet member P toward the curved surface 172*a*.

The curved surface 172*a* and the guide surface 172*b* form a contact portion 180 that comes into contact with the sheet member P over a region extending in the width direction of the sheet member P while the sheet member P is nipped by the nip portion 70. The contact portion 180 protrudes toward the sheet member P that is transported. The contact portion 180 is an example of a contact member. In the present exemplary embodiment, for example, the curved surface 172*a* has a radius of 2.4 mm.

In this configuration, the guide surface 172*b* of the contact portion 180 comes into contact with the leading end of the sheet member P that is transported by the fixing device 34. This will be described in detail below. The guide surface 172*b* guides the leading end of the sheet member P toward the curved surface 172*a*. The curved surface 172*a* of the contact portion 180 comes in contact with the image surface of the sheet member P and smoothes the surface of the toner image.

To smooth the surface of the toner image, the curved surface 172*a* of the contact portion 180 may be arranged to come into contact with the image surface of the sheet member P before the toner image solidifies. For this purpose, the distance from the nip portion 70 of the fixing device 34 to the curved surface 172*a* (L3 in FIG. 8) may be as short as possible. More specifically, the distance L3 may be less than or equal to 40 mm, preferably less than or equal to 35 mm, and more preferably less than or equal to 30 mm.

In addition, to smooth the surface of the toner image, the contact length over which the curved surface 172*a* comes into contact with the sheet member P in the transporting direction of the sheet member P (L4 in FIG. 10B) may be as short as possible. More specifically, the distance L4 may be less than or equal to 5 mm, preferably less than or equal to 4 mm, and more preferably less than or equal to 3 mm.

Pressing Roller 182

As illustrated in FIG. 8, the pressing roller 182 is disposed above the bottom plate 170 of the recessed portion 166 when viewed in the apparatus depth direction. The bottom end portion of the pressing roller 182 is disposed in the recessed portion 166.

The pressing roller 182 includes a shaft 182*a* that extends in the apparatus depth direction and a cylindrical portion 182*b* that is cylindrical and through which the shaft 182*a* extends. The pressing roller 182 is rotatably supported by support members (not shown) at both ends of the shaft 182*a*. When viewed in the apparatus depth direction, the center C of the shaft 182*a* and the contact portion 180 are on the opposite sides of a straight line (S1 in FIG. 8) that passes through the contact portion 48*a* between the first roller 52 and the second roller 54 of the discharge roller unit 48 and the nip portion 70 of the fixing device 34.

In this configuration, the pressing roller 182 comes into contact with the leading end of the sheet member P that is nipped by the nip portion 70, and starts to rotate. The pressing roller 182 that rotates regulates the transporting direction of the sheet member P so that the leading end of the sheet member P comes into contact with the guide surface 172*b* of the contact portion 180. Here, to regulate means to change the transporting direction of the sheet member P that is nipped by the nip portion 70.

Operation

The operation of the relevant structure according to the second exemplary embodiment will now be described.

Figure 9B:
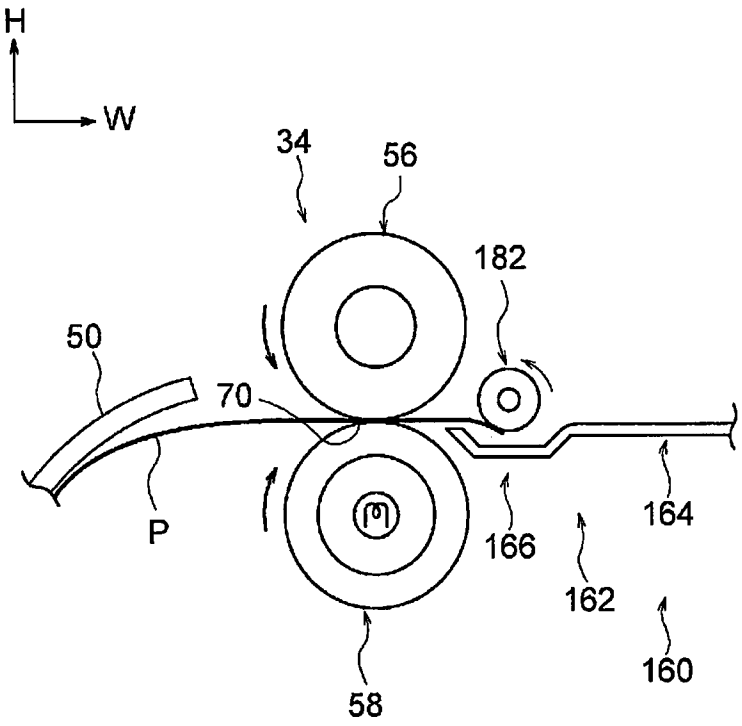
FIGS. 9A and 9B illustrate the manner in which the guide structure and other structures according to the second exemplary embodiment of the present disclosure transport a sheet member.
Figure 9A:
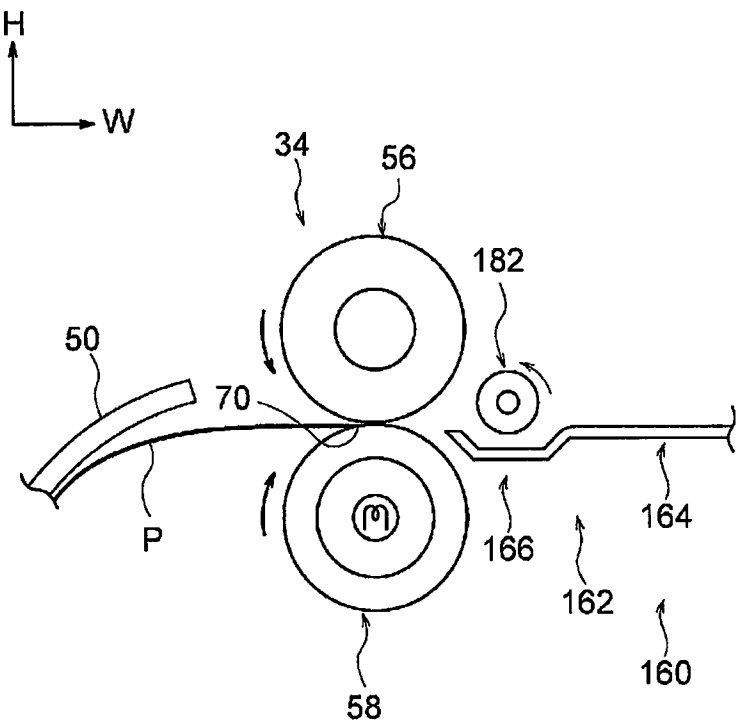

After the toner image is transferred to the sheet member P, the sheet member P is transported to the fixing device 34. Then, as illustrated in FIG. 9A, the heating roller 58 and the pressure roller 56 of the fixing device 34 transport the sheet member P by rotating while the sheet member P is nipped therebetween.

The pressure roller 56 presses the sheet member P against the heating roller 58, and the heating roller 58 heats the toner image formed on the sheet member P. Thus, the heating roller 58 heats the toner image formed on the sheet member P to, for example, about 100° C., so that the toner image is fixed to the sheet member P. As illustrated in FIG. 9B, the leading end of the sheet member P that is nipped and transported by the pressure roller 56 and the heating roller 58 comes into contact with the peripheral surface of the pressing roller 182. Then, the leading end of the sheet member P that is transported pushes the pressing roller 182 downstream in the transporting direction of the sheet member P.

The pressing roller 182 pushed by the sheet member P rotates to regulate the transporting direction of the sheet member P. More specifically, as illustrated in FIG. 10A, the pressing roller 182 that rotates regulates the transporting direction of the sheet member P so that the leading end of the sheet member P comes into contact with the guide surface 172*b* of the contact portion 180. Thus, the pressing roller 182 functions as a direction regulating member that regulates the transporting direction of the sheet member P that is transported.

Figure 10B:
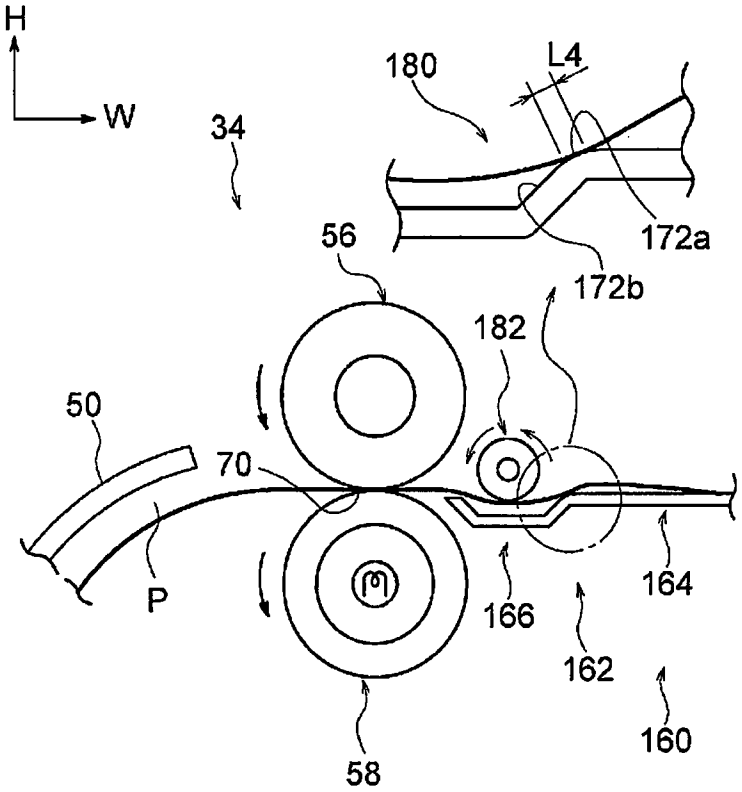
FIGS. 10A and 10B illustrate the manner in which the guide structure and other structures according to the second exemplary embodiment of the present disclosure transport the sheet member.
Figure 10A:
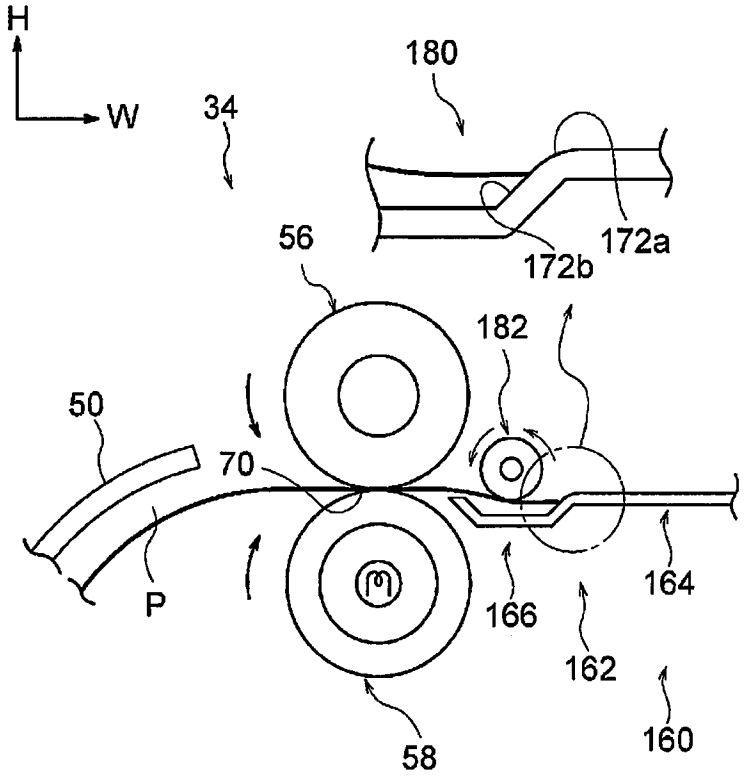

The guide surface 172*b* of the contact portion 180 comes into contact with the leading end of the sheet member P and guides the leading end of the sheet member P toward the curved surface 172*a*, as illustrated in FIG. 10B. The curved surface 172*a* of the contact portion 180 also comes into contact with the image surface of the sheet member P. More specifically, the curved surface 172*a* of the contact portion 180 extends in the width direction of the sheet member P, and comes into contact with the image surface of the sheet member P over a region from one end to the other end.

Thus, the pressing roller 182 regulates the transporting direction of the sheet member P so that the leading end of the sheet member P comes into contact with the guide surface 172*b*. As a result, the image surface of the sheet member P is pressed against the curved surface 72*a* of the contact member 72.

Figure 11:
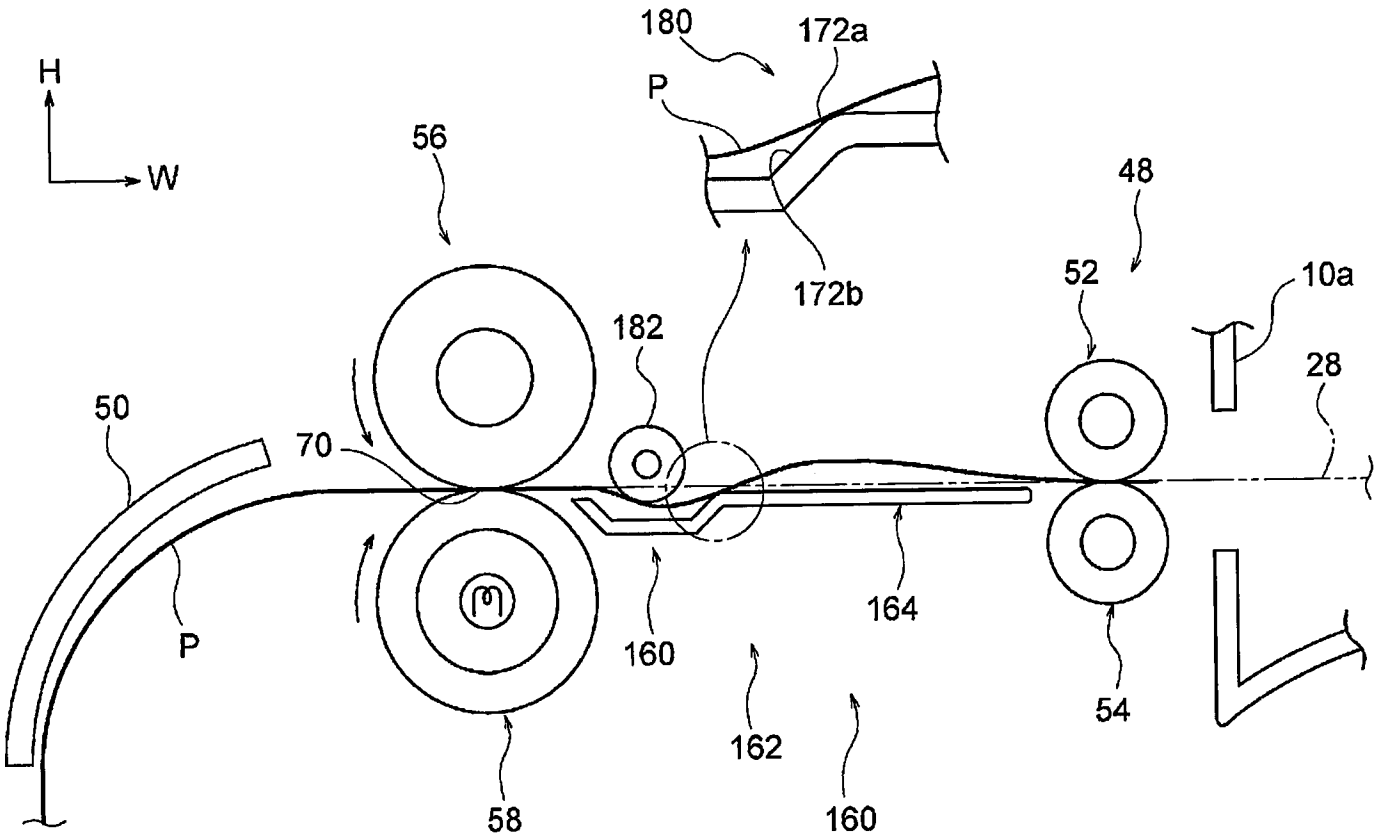
FIG. 11 illustrates the manner in which the guide structure and other structures according to the second exemplary embodiment of the present disclosure transport the sheet member.

Then, as illustrated in FIG. 11, the sheet member P is nipped between the first roller 52 and the second roller 54 of the discharge roller unit 48 at the leading end thereof and is transported by the discharge roller unit 48 while the sheet member P is nipped by the nip portion 70 and while the image surface of the sheet member P is in contact with the curved surface 172*a*. As a result, the surface of the toner image formed on the sheet member P is smoothed. Then, the discharge roller unit 48 transports the sheet member P to discharge the sheet member P to the outside of the apparatus body 10*a*.

SUMMARY

As described above, the pressing roller 182 regulates the transporting direction of the sheet member P so that the leading end of the sheet member P comes into contact with the guide surface 172*b*. Thus, the image surface of the sheet member P is pressed against the curved surface 172*a* of the contact member 72. As a result, the surface of the toner image formed on the sheet member P is smoothed, and the brightness of the toner image formed on the sheet member P is made more uniform.

Accordingly, variation in the pressing force is less than that in the case where the sheet member P is nipped between a transport roller and the curved surface 172*a* to press the sheet member P against the curved surface 172*a*, in which case the pressing force varies in accordance with variations in the relative positions of the transport roller and the curved surface 172*a*. Thus, the brightness of the toner image formed on the sheet member P is made more uniform.

Other effects of the second exemplary embodiment are similar to those of the first exemplary embodiment except for the effect provided by the fans.

Although specific exemplary embodiments of the present disclosure are described in detail above, the present disclosure is not limited to the above-described exemplary embodiments. It is obvious to those skilled in the art that various other exemplary embodiments are possible within the scope of the present disclosure. For example, although the fixing device 34 and the guide structure 60, 160 are separate structures in the above-described exemplary embodiments, the guide structure 60, 160 may instead be included in the fixing device 34. In such a case, the accuracy of the position of the guide structure 60, 160 relative to the pressure roller 56 and the heating roller 58 is higher than that in the case where the fixing device 34 and the guide structure 60, 160 are separate structures. Therefore, the brightness of the toner image formed on the sheet member P may be made more uniform.

In addition, although the sheet member P is pressed against the curved surface 72*a*, 172*a* by the fans 82 or the pressing roller 182 in the above-described exemplary embodiments, the sheet member P may instead be pressed against the curved surface by other external forces (urging forces), such as spring force.

In addition, although not described in the second exemplary embodiment, the pressing roller 182 may be a roller for reducing curling (decurler roller). In such a case, curling of the sheet member P is reduced by the pressing roller 182.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A guide structure comprising:

a contact member disposed downstream of a nipping portion in a transporting direction in which a recording medium is transported, the nipping portion nipping the recording medium between a heating roller, which heats an image formed on the recording medium that is transported, and a pressure roller, which presses the recording medium against the heating roller, the contact member protruding toward the recording medium and being rubbed against an image surface of the recording medium, on which the image is formed, while being in contact with the image surface over a region extending in a width direction of the recording medium and while the recording medium is nipped by the nipping portion; and a pressing member that presses the recording medium that is transported against the contact member, wherein the pressing member faces the contact member with a transport path disposed therebetween.

2. The guide structure according to claim 1, wherein the contact member extends in the width direction of the recording medium.

3. The guide structure according to claim 1, wherein the pressing member presses the recording medium against the contact member by blowing air toward the recording medium.

4. The guide structure according to claim 1, wherein the pressing member presses the recording medium against the contact member by regulating a transport path of the recording medium.

5. The guide structure according to claim 1, wherein the contact member is arranged to be pressed against the image surface of the recording medium that is nipped by the nipping portion.

6. The guide structure according to claim 5, wherein the contact member includes a curved surface that comes into contact with the image surface of the recording medium and a guide surface that comes into contact with a leading end of the recording medium that is transported and guides the leading end of the recording medium toward the curved surface.

7. A fixing device comprising:

a heating roller that heats an image formed on a recording medium that is transported;

a pressure roller that presses the recording medium against the heating roller; and the guide structure according to claim 1.

8. An image forming apparatus comprising:

a transfer unit that transfers an image to a recording medium that is transported; and the fixing device according to claim 7 that fixes the image that has been transferred by the transfer unit to the recording medium.

9. An image forming apparatus comprising:

a transfer unit that transfers an image to a recording medium that is transported;

a fixing device that fixes the image that has been transferred by the transfer unit to the recording medium; and the guide structure according to claim 1.

10. The guide structure according to claim 1, wherein a distance between a contact surface of the contact member and the nipping portion is in the range from 15 mm to 40 mm.

11. The guide structure according to claim 1, wherein a curved surface of the contact member comes into contact with the image surface of the recording medium before a toner image solidifies.

* * * * *